United States Patent [19]

Asari et al.

[11] Patent Number: 4,582,681

[45] **Date of Patent: * Apr. 15, 1986**

[54] METHOD AND APPARATUS FOR HOT ISOSTATIC PRESSING

[75] Inventors: Akira Asari, Osaka; Shiro Matsuura; Hidehiro Tsuzuki, both of Kobe; Yohichi Inoue, Nishinomiya; Masato Moritoki, Miki; Takao Fujikawa; Junichi Miyanaga, both of Kobe, all of Japan

[73] Assignee: Kabushiki Kaisha Kobe Seiko Sho, Kobe, Japan

[ * ] Notice: The portion of the term of this patent subsequent to May 15, 2001 has been disclaimed.

[21] Appl. No.: 435,662

[22] Filed: Oct. 21, 1982

[30] Foreign Application Priority Data

Oct. 24, 1981 [JP] Japan ..... 56-170506

[51] Int. Cl.[4] ..... B22F 3/12; C22D 1/02

[52] U.S. Cl. ..... 419/49; 419/48; 419/54; 419/55; 419/57; 419/42; 425/405 H; 264/57; 264/58; 264/66; 264/85; 264/517

[58] Field of Search ..... 419/48, 49, 54, 55, 419/57, 42; 425/405 H; 264/57, 58, 66, 85, 517, 332

[56] References Cited

U.S. PATENT DOCUMENTS

| | | | |
|---|---|---|---|
| 3,893,852 | 7/1975 | Bergman et al. | 419/49 |
| 4,359,336 | 11/1982 | Bowles | 419/49 |
| 4,448,747 | 5/1984 | Moritoki et al. | 419/49 |

*Primary Examiner*—Joseph L. Schofer
*Assistant Examiner*—Fred M. Teskin
*Attorney, Agent, or Firm*—Oblon, Fisher, Spivak, McClelland & Maier

[57] ABSTRACT

A hot isostatic pressing system including a hot isostatic pressing station having a high pressure container constituted by a vertical pressure-resistant cylinder closed at the top end thereof and a lower lid detachably fitted to the bottom of the pressure resistant cylinder and a treating chamber internally provided with a heater and enclosed by a heat insulating wall, and a mechanism for adjusting an atmospheric gas pressure and temperature of the pressing station into a condition suitable for the hot isostatic pressing of a work item accommodated in the treating chamber; a plurality of auxiliary stations each provided with an opening for receiving from beneath thereof the heat insulating wall of the treating chamber accommodating the internal heater and a work item, a support structure for supporting the heat insulating wall, and a mechanism for cooling the work item and internal heater in an inert gas atmosphere; a carriage for transferring the lower lid and work item or the lower lid, work item, heat insulating wall and internal heater between the hot isostatic pressing station and one of the auxiliary stations; and a lift mechanism for lifting up and down the lower lid and work item or the lower lid, work item, heat insulating wall and heater at the hot isostatic pressing station and each one of the auxiliary stations.

16 Claims, 8 Drawing Figures

METHOD AND APPARATUS FOR HOT ISOSTATIC PRESSING

BACKGROUND OF THE INVENTION

1. Field of the Invention

This invention relates to hot isostatic pressing (hereinafter referred to simply as "HIP" for brevity) treatment for sintering or densifying green compacts of ceramics, metal powder or the like.

2. Description of the Prior Art

The technology of the HIP which utilizes an inert gas under a high temperature condition for isostatic compression of a work item or workpiece has been attracting the attention of many concerns as an excellent method for producing sinters of high density from ceramic material, metal power or a mixture thereof, or for crushing residual voids in an ultrahard alloy or for diffusive bonding of metallic materials.

The products which are shaped or sintered by this method have a number of advantages as follows.

(a) A high degree of densification can be attained at a lower temperature as compared with the conventional sintering method, and it therefore becomes possible to obtain fine structure, preventing coarsening of crystal grains due to excessive growth;

(b) A density close to a theoretical value and a uniform structure are obtained in almost any kind of material;

(c) Powder spherical particles which are not suitable for die-molding can be consolidated to a sufficiently high density;

(d) Mechanical and physical properties of powder can be improved;

(e) The fine structure can contribute to the improvement of the properties of, for example, high speed steel tools;

(f) The size of the products is not limited by the press capacity as in the ordinary die molding press, so that it becomes possible to produce larger articles;

(g) A toxic and unstable material can be processed with a minimal affect on health;

(h) There can be produced various composite materials of ceramics, metal powder or the like; and (i) Material cost can be reduced by an improved yield and a reduction of defective products.

In addition to molding and sintering of powdery materials, the HIP treatment, which is capable of removing internal flaws of an object in a high-temperature and high-pressure atmosphere to increase its toughness and deflective strength, can be utilized for the treatment of sintered tool materials at high temperature and pressure, or for bonding turbine blades to a turbine body to form an extremely strong bond therebetween by diffusive bonding in a high pressure and temperature gas atmosphere.

The HIP treatment which is conducted in a high temperature and pressure atmosphere requires a costly HIP apparatus with a special construction, and usually takes a long cycle time for temperature elevation, pressurization, temperature drop and pressure relief, so that the reduction of the cycle time has been a great technical problem for the enhancement of the efficiency of the HIP operation. In order to solve this problem, there have thus far been made various attempts by using a preheating furnace for raising the temperature of a work item beforehand thereby restricting the operation in the HIP apparatus to pressurization and a certain extent of heating for the purpose of shortening the time period over which the HIP apparatus is occupied by a work item in each cycle of operation, namely, for efficient use of the HIP apparatus. A typical example is found in the apparatus described in British Pat. No. 1,291,459, which is as a matter of fact capable of shortening the cycle time, but has inherent drawbacks in that it entails a large equipment cost for the provision of a preheating furnace in addition to an ordinary HIP apparatus and that it involves an extremely large heat loss while transferring a preheated work item in the atmosphere. Moreover, it has a more detrimental drawback in that the inner wall surfaces in the lower portion of the high pressure cylinder is overheated by the radiant heat from the work item when inserting a preheated work item into the high pressure chamber, damaging the lower seal ring by the overheated inner wall of the high pressure cylinder. However, the safety characteristic of this sort of apparatus should be severely sought often, and the reduction of the cycle time should not be contemplated at the sacrifice of safety. In this connection, applicants disclosed in their copending application, Japanese Laid-Open Patent Application No. 51-124,610, a HIP system of high safety which can perform the HIP operation in a shortened cycle time without imposing adverse effects on the high pressure cylinder or other component parts of the system. More particularly, this copending application is directed to a HIP system wherein a high pressure chamber which is constituted by a high pressure cylinder and upper and lower plugs for sealing the openings at the upper and lower ends of the cylinder is provided with a heater within internal and external heat insulating walls, and a work item is placed on the lower plug to undergo the sintering or bonding treatment in a high pressure and temperature atmosphere, characterized in that the lower plug, heater and external heat insulating wall are integrally detachable from the high pressure cylinder, permitting opening and closing of the treating chamber defined by the external heat insulating wall and lower plug, providing seal means for the treating chamber and a gas passage in the lower plug to communicate the inner and outer sides of the treating chamber with an outside portion of the lower plug. According to this arrangement, it becomes possible to shorten the cycle time by preheating the work item and at the same time to limit the heat radiation from the work item to a minimum, coupled with the prevention of the overheating of the inner wall surfaces of the high pressure cylinder by heat radiation which would shorten the service life of the cylinder, thus ensuring higher security and safety of operation. Further, it is possible to carry out the preheating in a vacuum or a particular inert gas atmosphere, so that there can be employed for the heater or the external heat insulating wall a material which is susceptible to oxidation at high temperatures.

The heater generally employs a heating element of Fe-Al-Cr, molybdenum or graphite, of which Fe-Al-Cr has the highest resistance to oxidation at high temperatures, and is generally accepted as being usable in open air although it retains stability only up to 1100° C. at most. On the other hand, molybdenum- or graphite-base materials which show stability over 1100° C. can be exposed to the atmosphere only in the temperature range of 200°-300° C. as they undergo oxidation to a considerable degree at high temperatures. Therefore, after a HIP treatment in a high pressure inert gas atmosphere at a high temperature of one thousand and several hundreds degrees centigrade, the pressure can be lowered in a relatively short time period but it takes a long time to lower the temperature below 300° C. Consequently, the long time period over which the work item has to be retained in the HIP apparatus for cooling has been a detrimental obstacle to the efficient use of the HIP system. For example, the typical schedule of the time lengths which are required for the respective steps of the conventional HIP process is as follows.

| Steps | Time Lengths hr. | min. |
|---|---|---|
| Loading | 0. | 10 |
| Suctioning · gas replacement | 1. | 00 |
| Pressurization · Heating | 3. | 00 |
| Retention | 2. | 00 |
| Cooling-off | 8. | 00 |
| Press · relief · gas recovery | 1. | 00 |
| Ejection | | 10 |
| Total | 15. | 20 |

Reduction of the cycle time which is attained by the preheating is restricted to reduction to about 1 hour and 40 minutes for the time period of pressurization and heating which otherwise takes about 3 hours, a reduction as small as 8.7% of the cycle time, and the cooling time period which takes the major proportion of the cycle time has nothing to do with the preheating and still remains as a serious cause of the long cycle time of the HIP operation.

SUMMARY OF THE INVENTION

With the foregoing situations in view, the present inventors continued their research in an attempt to add further improvements or meliorations to the HIP system of above-mentioned applicants' copending application, and succeeded in developing a method and apparatus which can shorten the cycle time markedly to enhance to the efficiency of the HIP operation to a significant degree.

More specifically, according to the present invention, there is provided a hot isostatic pressing system, comprising a hot isostatic pressing station including a high pressure container constituted by a vertical pressure-resistant cylinder closed at the top end thereof and a lower lid detachably fitted to the bottom of the pressure resistant cylinder and a treating chamber internally provided with a heater and enclosed by a heat insulating wall, and means for adjusting an atmospheric gas, pressure and temperature of the pressing station into a condition suitable for the hot isostatic pressing of a work item accommodated in the treating chamber; a plurality of auxiliary stations each provided with an opening for receiving from beneath each station the heat insulating wall of the treating chamber accommodating the internal heater and a work item, a support structure for supporting the heat insulating wall; and means for cooling the work item and internal heater in an inert gas atmosphere; a carriage for transferring the lower lid and work item or the lower lid, work item, heat insulating wall and internal heater between the hot isostatic pressing station and one of the auxiliary stations; and a lift mechanism for moving up and down the lower lid and work item or the lower lid, work item, heat insulating wall and heater at the hot isostatic pressing station and each one of the auxiliary station.

According to the present invention, there is also provided a method of hot isostatic pressing by the use of such hot isostatic pressing system, the method repeating a cycle of operation comprising the following steps (a) to (e): (a) a step of loading into the hot isostatic pressing station a treating chamber accommodating a work item I and an internal heater within a heating insulating wall to subject the work item I to a hot isostatic pressing treatment including replacement by an inert gas, temperature and pressure elevation, retention of high temperature and pressure, relief of heating and pressurization, and gas recovery; (b) a step of, upon dropping the internal pressure of the hot isostatic pressing apparatus to a normal level, extracting the work item I from the isostatic pressing station together with the internal heater and surrounding hot inert gas atmosphere substantially in a shielded state within the heat insulating wall, followed by loading into an auxiliary station with cooling means; (c) a step of unloading from a second auxiliary station a similar treating chamber accommodating a work item II and an internal heater within a heat insulating wall, and loading the same into the hot isostatic pressing apparatus; (d) a step of subjecting the work item II to a hot isostatic pressing treatment in the pressing station in the same manner as in step (a), while cooling in an inert gas atmosphere the work item I and the internal heater loaded into the auxiliary station in step (b) and then replacing the treated work item I by a fresh work item I'; and (e) a step of unloading the work item II from the pressing station upon completion of the hot isostatic treatment and loading the same into another auxiliary station in the same manner as in step (b), and instead loading into the pressing station the treating chamber of the work item I' standing by at the auxiliary station since loading thereinto in step (d) in the same manner as in step (c).

The above and other objects, features and advantages of the present invention will become apparent from the following description and the appended claims, taken in conjunction with the accompanying drawings which show by way of example some preferred embodiments of the invention.

BRIEF DESCRIPTION OF THE DRAWINGS

FIGS. 2 to 4 are schematic views of various components of the HIP system of FIG. 1, of which FIG. 2 shows a treating chamber, FIG. 3 the treating chamber as positioned at an auxiliary station, and FIG. 4 the treating chamber as loaded into a high pressure container;

DETAILED DESCRIPTION OF THE PREFERRED EMBODIMENTS

Figure 1:
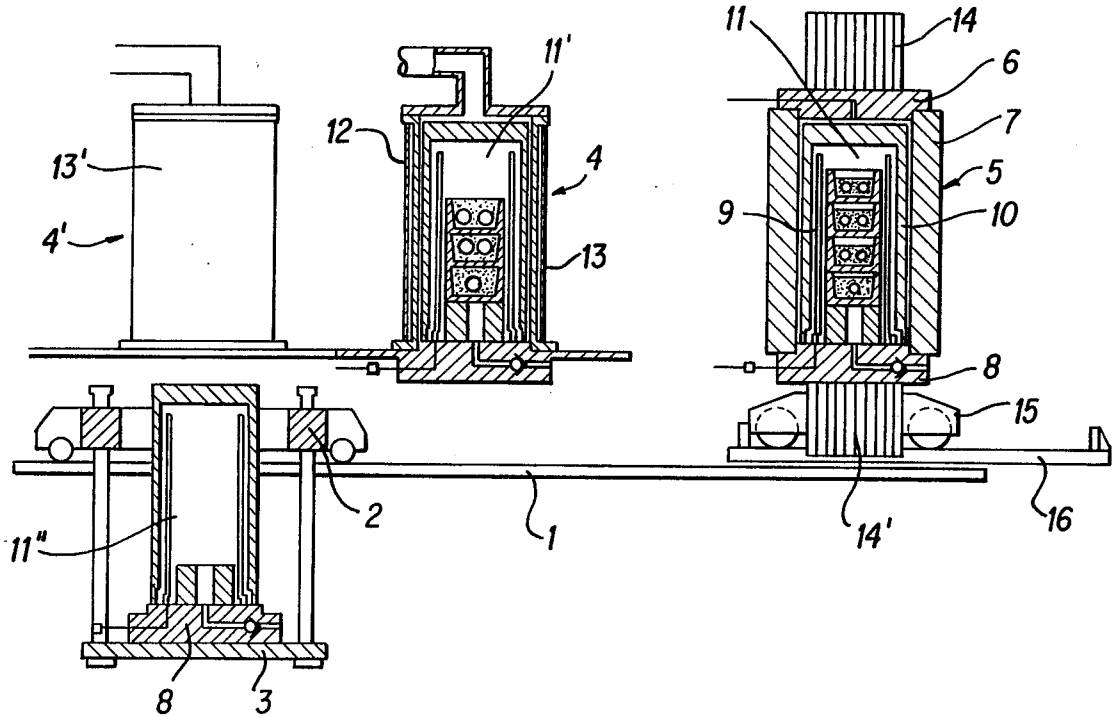
FIG. 1 is a schematic view of an HIP system embodying the present invention.

Referring first to FIG. 1, there is schematically shown the positional relationship between a HIP station and an auxiliary station in the HIP system according to the present invention, the system including a wheeled carriage 2 for travel on and along a rail 1. Supported on the carriage 2 is a seat plate 3 which is vertically movable up and down through a known drive mechanism such as a chain hoist mechanism, a worm gear and rack mechanism, a piston-cylinder or other suitable means (not shown). Located over the rail 1 are a plurality of auxiliary stations 4, 4' and an HIP station 5. The HIP station 5 is mainly constituted by a high pressure container which is formed by a vertical pressure-resistant cylinder 7, an upper lid 6 hermetically closing the top end of the cylinder 7 and an lower lid 8 detachably fitted in the lower end of the cylinder 7, and a treating chamber 11 surrounded by a heat insulating wall 10 of an inverted cup shape which is received in the high pressure container and supported on the upper surface of the lower lid 8. This treating chamber 11 can be removed out of the pressure resistant cylinder 7 by extracting the heat insulating wall 10 integrally with the lower lid 8. On the other hand, the auxiliary stations 4 and 4' are each provided with a dome type vessel 13 with a jacket for a cooling medium, which has an inner volume sufficient for accommodating a treating chamber 11, 11' or 11", the dome type vessel 13 having a bottom opening of a size and a shape suitable for fitting engagement with the lower lid 8.

The treating chambers 11, 11' . . . are mounted on the seat plate 3 of the carriage 2 and thereby transferred to the positions immediately beneath the vertical pressure resistant cylinder 7 or dome type vessel 13 or 13', where they are inserted into or extracted from the pressure-resistant cylinder 7 or the dome type vessel 13, 13' by the lift means. In the embodiment shown in FIG. 1, there are shown three treating chambers, namely, a first treating chamber 11 inserted in the HIP station 5, a second treating chamber 11' inserted in the auxiliary station 4, a third treating chamber 11" in a preparatory stage for receiving the workpieces, two auxiliary stations 4 and 4', and one HIP station 5. Press frames 14 and 14' which hold the upper and lower lids 6 and 8 are mounted on a wheeled carriage 15 which travels on and along a rail 16 for moving the frames between an operating position and a retracted rest position.

Figure 2:
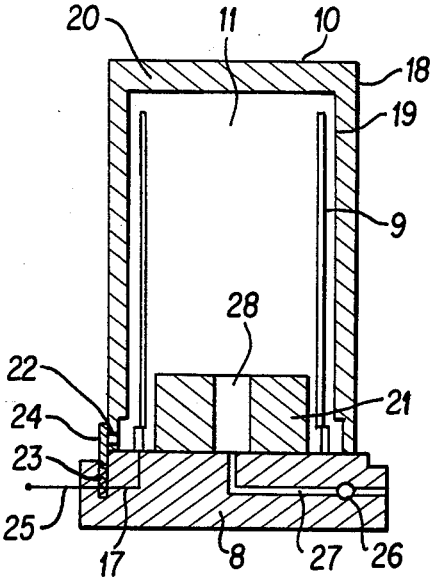

FIG. 2 illustrates in vertical section the treating chamber 11 of the system shown in FIG. 1. In FIG. 2, the heat insulating wall 10 has on its inner side an electric heating plate of the heater 9 which is mounted on the top surface of the lower plug 8 in an electrically insulated state. The heater 9 is supplied with power through lead wires 17 which are embedded in the lower lid 8 in a hermetically sealed and electrically insulated state. The heat insulating wall 10 which encloses the treating chamber 11 including the heater 9 is constituted by concentric inner and outer shells of inverted cup shape which are formed of a material of low gas permeability, and heat-resistant fibrous heat insulating material such as ceramic fibre filled between the inner and outer shells, and detachably mounted on top of the lower lid 8. The upper side of the lower lid 8 is covered with a heat insulating seat 21. The treating chamber 11 is communicable with the outside through a closable aperture 22 which is formed through the heat insulating wall 10. Namely, a plate-like member 24 which is fitted in a groove 2 formed on the upper side of the peripheral portion of the lower lid 8 is biased to project upwardly by a spring 25 to close the aperture 22 from outside, but which is pushed down by a projection provided in a lower portion on the inner periphery of the pressure resistant cylinder or the dome type vessel to uncover the aperture 22 when inserting the treating chamber into the HIP station or the auxiliary station. Although various modifications and alterations are conceivable with regard the construction for opening and closing the aperture 22, what is important here is that the treating chamber 11 be opened when inserted into the HIP station or the auxiliary station and closed upon extraction therefrom. An inert gas or other atmospheric gas is fed into the treating chamber 11 through a gas passage or conduit 27 provided in the lower lid 8 under on-off control of a valve 26 and a bore 28 in the heat insulating seat 21.

With the treating chamber 11 of the above-described construction, the heat insulating wall 10 is detached from the lower lid 8 to open the treating chamber 10 and, after placing work items on the top side of the lower lid 8, the treating chamber 11 is closed by fixedly mounting the heat insulating wall 10 again on the lower plug 8 to prepare for the HIP operation. In this instance, of course, the working efficiency can be enhanced by loading a plurality of workpieces according to the inner volume of the treating chamber 11.

The treating chamber 11 which has been loaded with the workpieces in this manner is inserted into the dome type vessel 13 at the auxiliary station 4, preheating the workpieces by the heater 9 after adjusting the atmosphere in the station to a predetermined condition. The system operation and its steps are hereafter described in greater detail with reference to FIG. 3.

Figure 3:
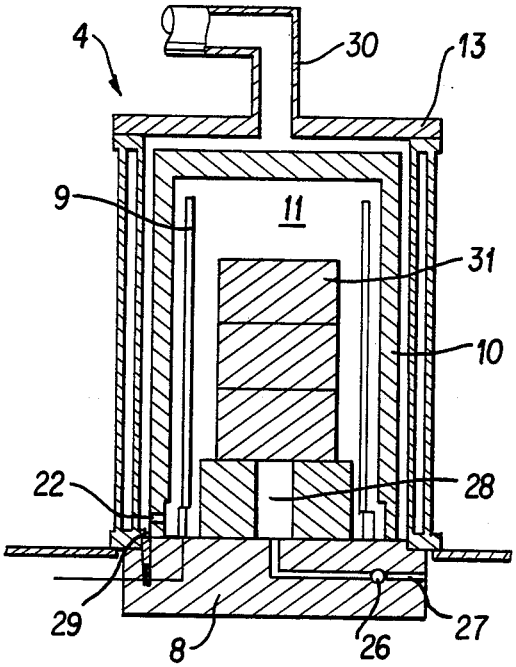

FIG. 3 illustrates in vertical section the treating chamber 11 as inserted in the dome type vessel 13, in which the open lower end of the dome type vessel 13 is hermetically fitted on the lower lid 8 of the treating chamber 11, opening the aperture 22 by pushing down the plate-like lid member 24 with a projection 29 which is provided on the inner periphery of the vessel 13 in a position close to its lower edge. Further, the dome type vessel 13 is provided with a gas passage or exhaust pipe 30 at its top end in communication with a vacuum pump (not shown). After inserting the treating chamber 11 into the dome type vessel 13 with its lower lid 8 in the bottom end of the dome type vessel 13 as shown and sealing its interior by fixation using a clamp mechanism or other suitable locking means, the suction pump is actuated to produce a vacuum or for replacement by a predetermined atmosphere. In the case of suctioning to vacuum, the treating chamber 11 can also be replaced by vacuum through the aperture 22 by holding the valve 26 in closed state. If the valve 26 is opened after the vacuuming, the treating chamber 11 and vessel 13 is filled with an atmospheric gas which is fed from conduit 27 and through the bore 28. Further, if the atmospheric gas is purged through the exhaust pipe 30, the atmospheric gas which is fed from the conduit 27 flows into the clearance between the dome type vessel 13 and the heat insulating wall 10 through the bore 28, treating chamber 11 and aperture 27, and is discharged through the exhaust pipe 30, so that it is possible to expose the workpieces 31 to an atmospheric gas under an arbitrary pressure by adjusting the feed and discharge rates of the atmospheric gas. In any case, the pressure in the treating chamber 11 is desirably maintained below the atmospheric pressure to prevent the workpieces from absorbing a large amount of gas.

The atmosphere in the auxiliary station 4 is adjusted to a predetermined condition in the above-described manner, and the heater 9 is energized to preheat the workpieces.

Although the preheating operation is carried out in the auxiliary station 4 as described above, the most important feature of the present invention accrues from the cooling in the auxiliary station. Namely, upon completion of the HIP treatment of high temperature and pressure in the HIP station 5, the treating chamber 11 which is still in a hot state is extracted from the HIP station 5 after pressure relief and then inserted into the auxiliary station 4 again for cooling. This cooling stage produces an important effect in the present invention, as described in greater detail hereafter.

The treating chamber 11 which is filled with the hot inert gas or other gaseous pressurizing medium is first extracted from the station 5 in a shielded state together with the lower lid 8, and then inserted into the dome type vessel 13 in which the atmospheric gas from the conduit 27 is charged and discharged in the same manner as described hereinbefore to continue to maintain the inert gas atmosphere in the treating chamber 11. In this stage, instead of energizing the heater, cold water or other cooling medium is passed through the cooling jacket 12 of the dome type vessel 13, whereupon the atmospheric gas which flows in from the conduit 27 is heated by depriving heat of the workpieces 31 and heater 9 as well as heat in the treating chamber 11, the heated atmospheric gas being discharged through the exhaust pipe 30 after heat exchange with the inner walls of the cooling jack 12. Although this cooling step takes a long time in the conventional HIP apparatus, the system of the present invention which carries out the cooling outside the HIP station makes it possible to shorten the cycle time of the HIP operation markedly, at the same time permitting to effect the cooling to a sufficient degree in an inert gas atmosphere and to use a heating element of molybdenum or other material which is susceptible to oxidation at high temperature in spite of stability at elevated temperatures.

Figure 4:
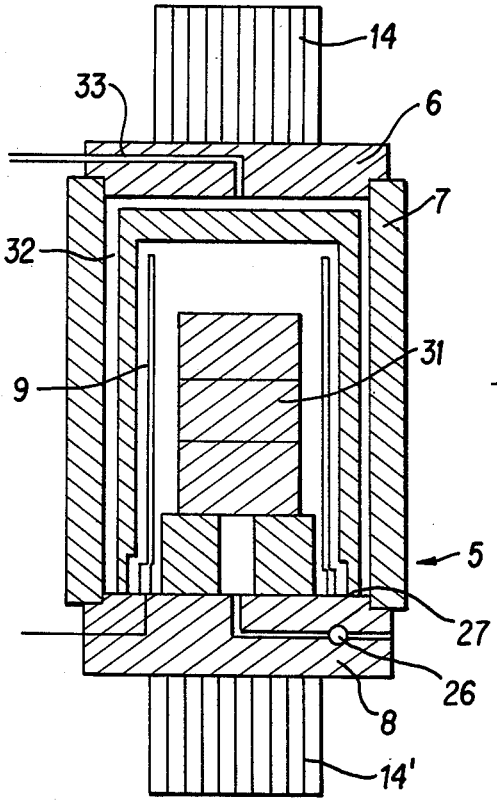

Upon finishing the preheating in the auxiliary station in the above-described manner, the station is replaced by an inert gas if it contains a vacuum atmosphere before detaching the lower lid 8 from the dome type vessel 13 to extract the treating chamber 11 from the auxiliary station 4 together with the workpieces which are accommodated in the treating chamber 4. The extracted treating chamber 11 is immediately inserted into the HIP station 5 for the HIP treatment. FIG. 4 illustrates in vertical section a treating chamber 11 as inserted in a HIP station, to undergo the HIP treatment as described in greater detail hereafter.

In FIG. 4, the HIP station 5 is internally formed with the high pressure chamber 42 which is defined by the pressure-resistant cylinder 7 with the upper and lower lids 6 and 8 hermetically fitted in the upper and lower ends of the pressure-resistant cylinder 7, respectively. Bored through the upper lid 6 is a gas passage or conduit 33 for feeding and exhausting a pressurizing gas medium therethrough. In the particular embodiment shown, the pressure resistant cylinder 7 is fixedly mounted on a support structure (not shown), and its upper and lower lids 6 and 8 are gripped between the press frames 14 and 14' to prevent their disengagement during the HIP treatment. Although the upper and lower lids 6 and 8 may be threaded into the upper and lower ends of the pressure resistant cylinder 7 in the usual manner if desired, it is instead recommended to grip them between the press frames to ensure security of the high pressure operation.

With the HIP station of the above-described construction, after inserting the treating chamber 11 into the pressure resistant cylinder 7 which internally maintains a high temperature condition, the lower lid 8 which carries the treating chamber 11 is hermetically fitted into the lower end of the pressure resistant cylinder 7 to fix the treating chamber 11 in position in the HIP station. After closing the valve 26, a pressurizing gas medium is introduced into the high pressure chamber 32 through the conduit 33 and the heater is continuedly held in energized state to start the HIP treatment.

For pressurization, there may be employed an inert gas such as argon gas and helium gas as a gaseous pressurizing medium at a level of about 500 atms, while the temperature for the HIP treatment is set at a level which is high enough for causing plastic fluidization of the ceramics or metallic material which constitutes the workpieces. By the HIP treatment, the workpieces are consolidated into products of high density which is akin to the theoretical density.

Upon completion of the HIP treatment, the pressurizing gas is discharged through the conduit 33 to restore normal pressure in the furnace, and, without waiting for the temperature to drop, the press frames 14 and 14' are retracted and the lower lid 8 is detached from the cylinder 7, removing the treating chamber 11 from the HIP station 5 and inserting the same into the auxiliary station 4 together with the workpiece for cooling.

Figure 5:
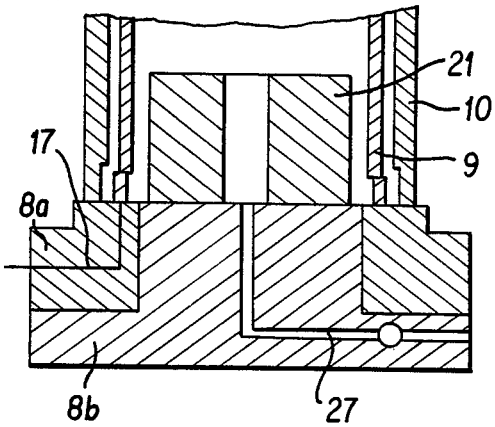
FIG. 5 is a fragmentary schematic view of a treating chamber of a modified construction.

Referring to FIG. 5, there is shown in fragmentary vertical section a treating chamber with a lower lid of an improved construction. More particularly, in this lid construction, the lower lid 8 consists of an annular outer lid member **8*a* mounting thereon the heat insulating wall 10 of inverted cup shape and the heater 9, and an inner lid member 8*b* detachably fitted in the outer lid member 8*a* and mounting thereon the heat insulating seat 21. With this lid construction, there is no need for extracting the treating chamber 11 from the auxiliary station 4 and removing the heat insulating wall 10 from the lower lid each time when loading or unloading the workpieces. In other words, the loading and unloading operations can be performed without inserting or extracting the treating chamber 11 into or from the auxiliary station 4, simply by fitting lid member 8*b* and the heat insulating seat 21 into and out of the outer lid member 8*a***.

In the HIP system according to the present invention, the heater 9 may employ a Ni-Cr wire, a Fe-Cr-Al wire or a molybdenum wire or graphite as a heating element depending upon the treating temperature, of which molybdenum and graphite are preferred in view of their stability at high temperatures. Further, the inner shell 19 of the heat insulating wall 10 is formed of a material of low gas permeability such as stainless steel, a heat resistant alloy or molybdenum similarly depending upon the processing temperature. In a case where molybdenum is used for both the inner wall 19 of inverted cup shape and the heating element of the heater 9 for a HIP treatment in the treating chamber 11 at 1400° C., it is possible to obtain stable heating during the HIP treatment as well as in the preheating stage without causing sublimation of molybdenum, by effecting the preheating at a temperature of up to 1400° C. and conducting the treatment in an argon gas atmosphere by replacing the treating chamber with argon gas atmosphere after suctioning to obtain a vacuum of 10 - 10 Torr. Moreover, it has been confirmed that there occurs substantially no oxidation if the treating chamber is opened to the atmosphere after cooling to a temperature below 300° C.

In the above-described HIP system of the present invention, the HIP treatment is carried out by the combination of movable treating chambers 11 and a HIP station 5, and the treating chamber 11 is transferred to and fitting in an auxiliary station 4 as soon as the internal pressure of the HIP station 5 is dropped to a normal level without waiting for a temperature drop, shielding the treating chamber 11 from the outside during the transfer. While the treating chamber 11 is cooled in the auxiliary station, another treating chamber 11 which carries preheated workpieces is inserted into the HIP station 5 for the HIP treatment. Therefore, the HIP station is occupied by the treating chamber for a shortened time period owing to the reduction of the cooling time, permitting shortening of the cycle time of the HIP process to an extremely short time length. In addition, the preheating operation can be carried out in a facilitated manner by the combined use of the auxiliary station which is adapted to preheat a treating chamber 11 concurrently with the HIP treatment in the HIP station 5, without necessitating the provision of a costly furnace exclusively for preheating purposes. This contributes to reducing equipment costs, to holding the thermal energy losses to a minimum, and to further shortening the cycle time of the HIP treatment, as compared with the conventional system in which the HIP apparatus is resorted to for both the preheating and HIP operations.

Figure 6:
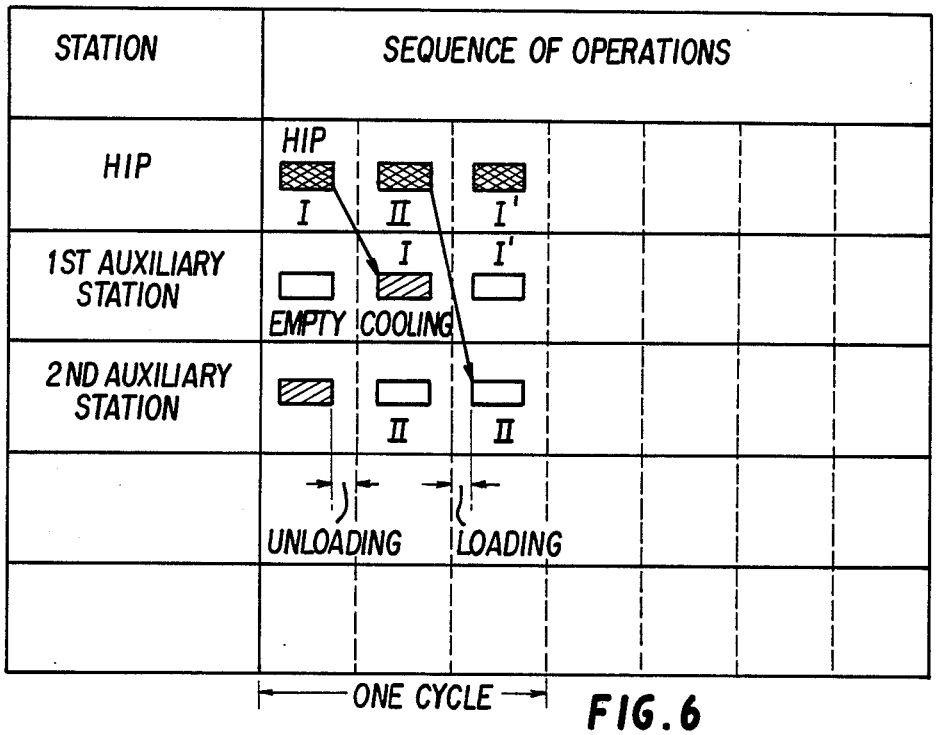
FIG. 6 is a chart of a program for carrying out the method of the invention.

The HIP operation can be performed with a high efficiency and in a rationalized manner by operating according to a predetermined program a plurality of treating chambers 11, 11' . . . , two auxiliary stations 4 and 4', and a HIP station as shown particularly in FIG. 1. Such programmed operation of the HIP system according to the invention is described in greater detail with reference to the chart of FIG. 6 showing the operating programs of the HIP station and the respective auxiliary stations in the system according to the invention.

In the first place, a work item I is subjected to the HIP treatment in the HIP station, which consists of suctioning to vacuum, replacement with an inert gas, pressure elevation, temperature elevation, retention of high pressure and temperature, cooling and quick pressure draining and gas recovering steps. In a standard process, the time lengths required by these steps are:

| | | |
|---|---|---|
| Work loading | | 10 min. |
| Pressure & temperature elevation | 1 hr | 00 min. |
| Suctioning & replacement with inert gas | 3 hrs | 00 min. |
| Retention of high press · & temp. | 2 hrs | 00 min. |
| Temperature relief | 1 hr | 00 min. |
| Quick press · draining & gas recovery | 1 hr | 00 min. |
| Unloading | | 10 min. |
| Total | 8 hrs | 20 min. |

In contrast to the conventional process which requires 3 hrs for cooling, the work item I is immediately extracted from the HIP station after 1 hour's temperature relief and pressure draining, and transferred to and inserted into a first auxiliary station for cooling, shielding from the outside the work item I, the heater and the surrounding atmospheric gas by the heat insulating wall during the transfer to the first auxiliary station. In the next phase of the operation, the work item II which is loaded in a second auxiliary station and the heater are extracted therefrom along with the enclosing heat insulating wall, and inserted into the HIP station. While the work item II undergoes the HIP treatment therein, the work item I and the heater are cooled off in an inert gas atmosphere in the first auxiliary station, loading a fresh work item I' after unloading the cooled work item I. In the next phase of operation, the work item II which has finished the HIP treatment is charged into the second auxiliary station, and the work item I' which has been standing by in the first auxiliary station is charged into the HIP station. By repeating the series of the above-described operations, the cycle time for a standard HIP process can be shorted to 8 hours and 20 minutes, contrasted with to the conventional cycle time of 15 hours and 20 minutes.

Figure 7:
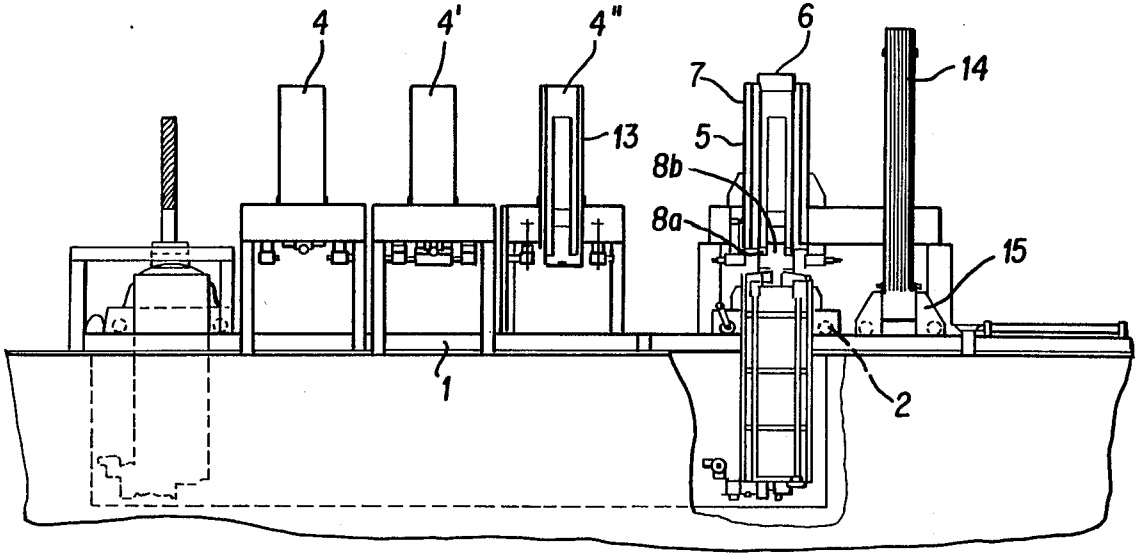
FIG. 7 is a schematic view of another embodiment of the present invention.

FIG. 7 shows in a side elevational view of a HIP system according to the present invention which is capable of performing the HIP operation with a further enhanced efficiency, in which the component parts common to FIG. 1 are designated by similar reference numerals. The system of FIG. 7 employs three auxiliary stations 4, 4' and 4'' and three treating chambers for one HIP station 5, which are operated according to the program shown in the chart of FIG. 8.

Figure 8:
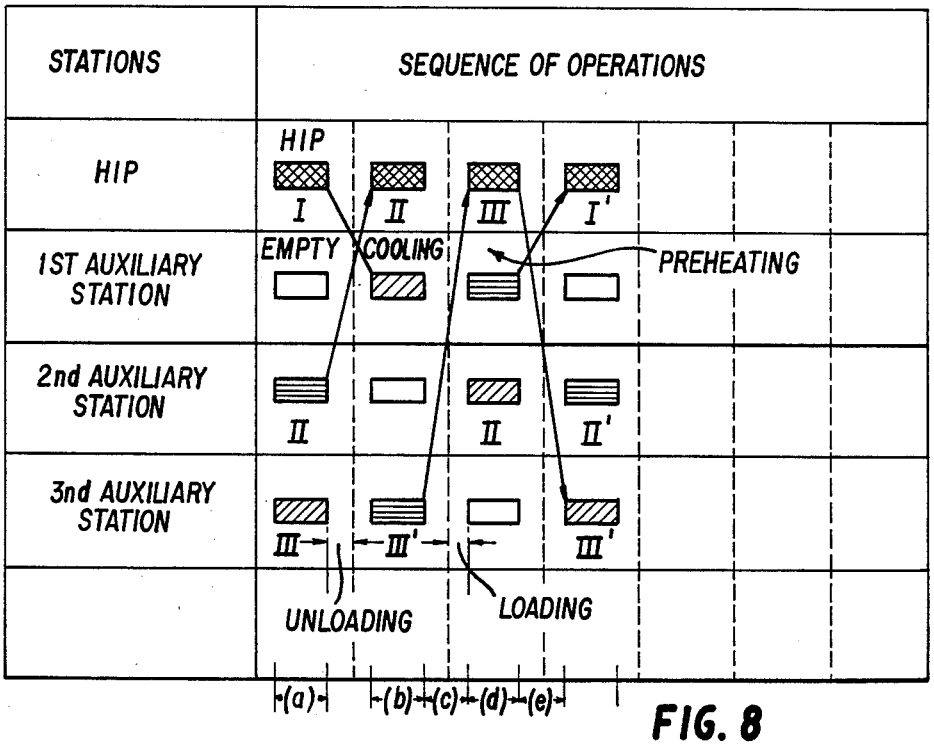
FIG. 8 is a chart of a program for carrying out the method of the invention by the embodiment of FIG. 7.

Referring to FIGS. 7 and 8 which illustrate a modified embodiment of the invention, a treating chamber which accommodates a work item I is shown as being charged in the HIP station 5 in FIG. 7. After charging, the carriage 2 is moved to the left in the figure, and the press frame 14 is advanced from a retracted rest position to its operating position to grip the upper and lower lids 6 and 8, followed by an HIP treatment consisting of the above-described steps. In the meantime, another workpiece II is preheated in an inert gas atmosphere at the second auxiliary station 4', and a workpiece III which has undergone the HIP treatment is cooled in an inert gas atmosphere at the third auxiliary station (Step a).

As soon as the internal pressure of the HIP station 5 is dropped to a normal level, the treated workpiece and the heater which are enclosed in a hot inert gas atmosphere and shielded from the outside by the heat insulating wall are extracted from the HIP station 5 without waiting for the temperature to drop, and then charged into the first auxiliary station 4. Then, the preheated workpiece II and the heater which are enclosed in a hot inert gas atmosphere and substantially shielded from the ambient atmosphere by the heat insulating wall are taken out of the second auxiliary station and charged into the HIP station 5, while the workpiece III which has undergone the cooling treatment is replaced by a fresh workpiece III' (Step b).

Similarly to the above-described Step (a), while the workpiece II is undergoing the HIP treatment, the workpiece III' is preheated at the third auxiliary station 4'', and the workpiece I is cooled at the first auxiliary station (Step c).

Also similarly to Step (b), the workpiece II in the heater is taken out of the HIP station 5 and charged into the second auxiliary station 4' in the next step, then extracting the workpiece III' and the heater from the third auxiliary station and inserting same into the HIP station 5. The treated workpiece I is replaced by a fresh workpiece I' (Step d).

In the next step, similarly to the operation in Step (a), while the workpiece III' is undergoing the HIP treatment, the workpiece I' is preheated at the first auxiliary station 4, and the workpiece II is cooled at the second auxiliary station (Step e).

Next, in a manner similar to Step (b), the treating chamber accommodating the workpiece III' is extracted from the HIP station 5 and inserted into the third auxiliary station 4", and the workpiece I' which is taken out of the first auxiliary station 4 is inserted into the HIP station 5. The treated workpiece II is replaced by a fresh workpiece II' (Step f).

By repeating the above-described operations of the sequential steps, the standard HIP process including the preheating operation can be completed in a cycle time of 7 hours, half of the conventional cycle time of 14 hours.

As discussed hereinbefore, in contrast to the conventional process in which the HIP apparatus is occupied for a long time period for the pressure reducing and cooling operation, the work and heater are extracted from the HIP station together with the hot inert gas atmosphere for cooling at an auxiliary station according to the method and apparatus of the present invention to thereby shorten the cycle time of the HIP treatment for drastic improvement of production efficiency. Further, the conventional method takes an extremely long time in preheating a work at a low pressure in the HIP apparatus prior to the pressing operation with the pressurizing gas medium continuously occupying the costly HIP apparatus which is designed for heating at high pressure. In contrast, the HIP system of the present invention employs transferable treating chambers which are each internally provided with a heater and enclosed by a heat insulating wall, effecting the low pressure heating at an auxiliary station to perform the HIP operation of excellent efficiency with a further shortened cycle time. Further, the system is provided with a plurality of treating chambers and auxiliary stations for a single HIP apparatus, carrying out the preheating or cooling operation at the auxiliary station or loading or unloading operation concurrently with the HIP treatment, so that a preheated work can be loaded into the HIP apparatus upon completion of HIP treatment of a preceding work item, deleting the time for the conventional cooling operation in the HIP apparatus for further reduction of the cycle time. Moreover, the HIP operation can be carried out in a semi-continuous manner by the use of a single HIP apparatus, making it possible to cut the production cost to a considerable degree.

The HIP system of the present invention can produce sinters of high density with a high efficiency particularly in a case where preliminarily sintered compacts of ceramics or metal powder are further consolidated by HIP treatment, carrying out the preliminary sintering by inserting a treating chamber in the auxiliary station and succeedingly transferring the same to the HIP station to there undergo the HIP treatment. Moreover, among various possibilities of applications, it can be advantageously applied to a process in which a compact of the above-mentioned powdery material is embedded in glass powder in a crucible as shown in FIG. 1, and the compact is completely shielded in molten glass in a heating stage prior to an HIP treatment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of hot isostatic pressing by a hot isostatic pressing system including a hot isostatic pressing station and at least first and second auxiliary stations, said method repeating a cycle of operation which comprises:

a first step of loading into said hot isostatic pressing station a first container accommodating a first work item and an internal heat within a heat insulating wall to subject said first work item to hot isostatic pressing treatment including inert gas purge, heating and pressurization, maintaining high temperature and pressure, and depressurization;

a second step of depressurizing said hot isostatic pressing apparatus to atmospheric pressure, unloading said first work item from said isostatic pressing station together with the internal heater and surrounding a hot inert gas atmosphere substantially in a shielded state within the heat insulating wall, and subsequently loading said first work item into said first auxiliary station provided with cooling means;

a third step of unloading from said second auxiliary station a second container similar to said first container accommodating a second work item and an internal heater within a heat insulating wall, and loading said second work item into said hot isostatic pressing station;

a fourth step of subjecting said second work item to hot isostatic pressing treatment in said hot isostatic pressing station in the same manner as in said first step, while cooling in an inert gas atmosphere said first work item and the internal heater loaded into said first auxiliary station in said second step and then replacing the treated first work item by a third work item; and a fifth step of unloading said second work item from said hot isostatic pressing station upon completion of said treatment and loading the second work item into second auxiliary station in the same manner as in said second step, and loading into said hot isostatic pressing station said first container accommodating said third work item.

2. A method of hot isostatic pressing by a hot isostatic pressing system including a hot isostatic pressing station and at least first, second and third auxiliary stations, said method including repeating a cycle of operation which comprises:

a first step of loading into said hot isostatic pressing station a first container accommodating a first work item and an internal heater within a heat insulating wall to subject said first work item to hot isostatic pressing treatment including inert gas purge, heating and pressurization, maintaining high temperature and pressure, and depressurizing, while simultaneously preheating a second work item in an inert gas atmosphere in a second container similar to said first container loaded into said second auxiliary station, and cooling a treated third work item in an inert gas atmosphere in said third auxiliary station;

a second step of, upon depressurizing of said hot isostatic pressing station to atmospheric pressure, unloading said first work item from said isostatic pressing station together with the internal heater and a surrounding hot inert gas atmosphere substantially in a shielded state within the heat insulating wall and loading said first work item into said first auxiliary station, while unloading said second work item from said second auxiliary station together with the internal heater and surrounding hot inert gas atmosphere substantially in a shielded state within the heat insulating wall for loading into said hot isostatic pressing station, and replacing the cooled third work item by a fourth work item;

a third step of subjecting said second work item to a hot isostatic pressing treatment in the same manner as in said first step, while preheating said fourth work item at said third auxiliary station, and cooling said first work item at said first auxiliary station;

a fourth step of unloading said second work item and the internal heater from said hot isostatic pressing station in the same manner as in said second step and loading second work item into said second auxiliary station, unloading said fourth work item and the internal heater from said third auxiliary station and loading said fourth work item into said hot isostatic pressing station, and replacing the treated first work item by a fifth work item;

a fifth step of subjecting said fourth work item to a hot isostatic pressing treatment in the same manner as in said first step, while preheating said fifth work item at said first auxiliary station, and cooling said second work item at said second auxiliary station; and a sixth step of unloading said fourth work item and an internal heater from said hot isostatic pressing station and loading said fourth work item into said third station in the same manner as in said second step, unloading said fifth work item and internal heater from said first auxiliary station and loading said fifth work item into said hot isostatic pressing station, and replacing the treated second work item by a sixth work item.

3. The method of hot isostatic pressing as set forth in claim 1 or 2, wherein said internal heater further comprises a heating element of molybdenum or graphite.

4. The method of hot isostatic pressing as set forth in claim 1, further comprising lowering the temperature of hot work and heater below 300° C. by the cooling treatment at said first and second auxiliary stations.

5. A hot isostatic pressing system comprising:

a hot isostatic pressing station including a high pressure container which further comprises a vertical pressure cylinder closed at the upper end thereof and a lower lid member detachably fitted to a bottom portion of said pressure cylinder, a treating chamber internally provided with a heater and enclosed by a heat insulating wall, and means for controlling pressure and temperature under a condition suitable for hot isostatic pressing of a work item accommodated in said treating chamber;

a plurality of auxiliary stations each of which has an opening formed therein for receiving from beneath thereof said heat insulating wall of said treating chamber accommodating said internal heater and said work item and each of which further comprises a support structure for supporting said heat insulating wall and means for cooling said work item and internal heater in an inert gas atmosphere;

a carriage for transferring said lower lid and work item or said lower lid, said work item, said heat insulating wall and said internal heater between said hot isostatic pressing station and one of said plurality of auxiliary stations; and a lift mechanism for lifting up and down said lower lid and work item or said lower lid, work item, heat insulating wall and heater at said hot isostatic pressing station and each one of said plurality of auxiliary stations.

6. The hot isostatic pressing system as set forth in claim 5, further comprising a lead wire embedded in said lower lid and power supply means wherein said heater further comprises an electric heater having a heating element of molybdenum or graphite and connected to said power supply means through said lead wire.

7. The hot isostatic pressing system as set forth in claim 5 or 6, further comprising a support structure wherein said hot isostatic pressing station is fixedly mounted on said support structure; and a press frame movable from a retracted rest position to an operating position for supporting an upper lid and said lower lid of said high pressure container during hot isostatic pressing operation.

8. The hot isostatic pressing system as set forth in claim 5 or 6, wherein said lower lid further comprises an annular outer lid member fixedly supporting thereon a heat insulating wall of an inverted cup shape and a heater provided on the inner side thereof, and an inner lid member detachably fitted to said outer lid member for supporting thereon said work item through a heat insulating seat.

9. The hot isostatic pressing system as set forth in claim 5 or 6, wherein said vertical pressure resistant cylinder further comprises a cooling jacket positioned around the outer periphery thereof.

10. The hot isostatic pressing system as set forth in claim 5 or 6, wherein said plurality of auxiliary stations further comprise two auxiliary stations per single hot isostatic station.

11. The hot isostatic pressing system as set forth in claim 5 or 6, wherein said plurality of auxiliary stations further comprise three auxiliary stations per single hot isostatic pressing station.

12. The hot isostatic pressing system as set forth in claim 5, wherein each of said plurality of auxiliary stations further comprise a cooling jacket.

13. The hot isostatic pressing system as set forth in claim 5 or 12, wherein said auxiliary station further comprises means for measuring the temperature in said treating chamber.

14. The hot isostatic pressing system as set forth in claim 5 or 12 wherein said auxiliary station further comprises means for controlling the temperature in said treating chamber.

15. The hot isostatic pressing system as set forth in claim 5 or 12, wherein each of said plurality of auxiliary stations further comprise means for adjusting the atmosphere.

16. The hot isostatic pressing system as set forth in claim 5 or 12 wherein each of said plurality of auxiliary stations further comprises lower lid clamp means.

* * * * *